US006927660B2

(12) United States Patent
Okamoto

(10) Patent No.: US 6,927,660 B2
(45) Date of Patent: Aug. 9, 2005

(54) COIL DEVICE WITH EDGEWISE WINDING

(75) Inventor: Toshinori Okamoto, Iwata-gun (JP)

(73) Assignee: Minebea Co., Ltd., Kitasaku-Gun (JP)

( * ) Notice: Subject to any disclaimer, the term of this patent is extended or adjusted under 35 U.S.C. 154(b) by 0 days.

(21) Appl. No.: 10/640,251

(22) Filed: Aug. 14, 2003

(65) Prior Publication Data

US 2004/0041676 A1 Mar. 4, 2004

(30) Foreign Application Priority Data

Sep. 3, 2002 (JP) ..... 2002-257776

(51) Int. Cl.[7] ..... H01F 27/29
(52) U.S. Cl. ..... 336/192; 336/208; 336/198
(58) Field of Search ..... 336/198, 208, 336/192, 200, 83

(56) References Cited

U.S. PATENT DOCUMENTS 6,661,187 B1 * 12/2003 Park ..... 315/411
6,727,793 B2 * 4/2004 Piechnick ..... 336/198
6,781,499 B2 * 8/2004 Steiner ..... 336/192
2003/0052767 A1 * 3/2003 Yamanobe et al. ..... 336/232

* cited by examiner

*Primary Examiner*—Anh Mai
(74) *Attorney, Agent, or Firm*—Oliff & Berridge PLC

(57) ABSTRACT

A coil device comprises at least one edgewise winding of a rectangular insulated wire and a holder on which the winding is mounted. The holder includes a plurality of terminal sections each composed of a terminal pin having one end portion adapted to be inserted in a printed circuit board, and having the other end portion embedded in the bottom side of a base section of the holder and connected to the winding. The holder further includes two side walls each having a wire path on at least one of its both sides. Each wire path has a curve guide at its lower end, and the rectangular wire is elastically curved along the curve guide and has its termination crooked and hooked around the other end portion of the terminal pin.

13 Claims, 4 Drawing Sheets

COIL DEVICE WITH EDGEWISE WINDING

BACKGROUND OF THE INVENTION

1. Field of the Invention

The present invention relates to a coil device functioning as a transformer or choke coil used in various electronic circuits, and more particularly to a coil device having an edgewise winding of a rectangular insulated wire.

2. Description of the Related Art

Since, in recent years, the miniaturization and higher performance of an electric apparatus have been required, a coil device such as a transformer or line filter is also required to be miniaturized and be higher in performance. Conventionally, a round insulated wire has been used for a winding in the coil device, but an edgewise winding of a rectangular insulated wire has the following advantages over the winding of the round insulated wire, and is increasingly often used. Firstly, the edgewise winding can achieve higher performance, higher efficiency, miniaturization and lower-profile due to its larger conductor occupation ratio. Secondary, the edgewise winding has a smaller stray capacity and therefore can realize better frequency characteristics. Thirdly, the edgewise winding does not require a process of winding a wire on a bobbin, and is easier to assemble, resulting in an easier automation of the manufacturing process.

A coil device, which uses the above-mentioned edgewise winding, comprises, for example: a case which is formed of resin, and which includes a case body and case lid; and a coil which comprises a core and a winding formed of a rectangular insulated wire wound edgewise around the core and having lead wires, and which is disposed in the case body. In the coil device thus structured, at least one lead wire each winding is fitted in a groove formed on the inner surface of the case body, and a harness lead wire is inserted in a hole formed in the lead wire and soldered. The coil device is disclosed in Japanese Patent Publication No. Hei 10-241955, and refer to FIG. 6 thereof.

A surface-mount choke coil is disclosed in Japanese Patent Publication No. Hei 08-236364, which is formed such that a rectangular insulated wire is wound edgewise around the center leg of an EE-core, and both ends of the edgewise winding lead out respectively at sides of the core opposite to each other, and that the both ends leading out have their insulation peeled off to form flat connection portions (refer to FIG. 3 of the Japanese Patent Publication No. Hei 08-236364).

A surface-mount compact coil device is disclosed in Japanese Patent Publication No. Hei 11-345721, which comprises a pair of cores formed of magnetic material, at least two windings, and a bobbin, and in which at least one of the at least two windings is an edgewise winding of a rectangular insulated wire, and the edgewise winding and a flat winding are stacked with the core disposed inside the stacked windings (refer to FIG. 1 of the Japanese Patent Publication No. Hei 11-345721).

In the various types of edgewise windings used in the above-described coil devices, the starting and finishing ends of the rectangular insulated wires are usually soldered directly to a printed circuit board (hereinafter referred to as "PCB"). For example, referring to FIG. 5 showing a conventional coil device, staring and finishing ends of a rectangular wire leading out so as to work as terminals are let through holes formed in a PCB (not shown) and each shaped substantially rectangular corresponding to the cross-sectional configuration of the wire, and referring now to FIG. 6 showing another conventional coil device, starting and finishing ends of a rectangular wire are worked upon to come up with a structure suitable for surface-mount on a PCB taking advantage of its rectangular cross-sectional shape.

As shown in FIGS. 5 and 6, a holder 2 comprises two side walls 18 and 19 disposed respectively on its both sides, and two slot holes 4 and 4 for engagingly receiving a core securing plate spring 3 are each formed in the upper portion of each of the side walls 18 and 19. A core 5 is inserted in an edgewise winding 6 of a rectangular insulated wire, then is mounted on a base section 10 of the holder 2, and is secured thereto with the plate spring 3. End portions (terminations) 61 and 62 of the edgewise winding 6 have their insulation resin peeled off, are plated with solder, and lead out extending along respective wire paths 11 and 11.

In the coil device shown in FIG. 5, the terminations 61 and 62 are let through the aforementioned holes which are formed in the PCB (not shown) and which are shaped substantially rectangular corresponding to the cross-sectional configuration of the rectangular wire. On the other hand, in the coil device shown in FIG. 6, the terminations 61 and 62 are bent at respective corners of the base section 10 for enabling the coil device to be surface-mounted on the PCB (not shown). However, a terminal configuration of the terminations 61 and 62 shown in FIG. 5 causes such a problem that the coil device comes off from the PCB due to a mechanical vibration when the coil device is relatively high or heavy, thus limiting the size and weight of the coil device, and a terminal configuration of the terminations 61 and 62 shown in FIG. 6 comes up with a problem on a mechanical strength of the rectangular wire itself when the wire has a relatively small current capacity (thin wire) or the coil device is heavy. In the conventional terminal configurations, the coil device, such as a transformer or choke coil, mounted on the PCB must have its size and weight limited in order to stay stably secured thereon. And, since a conventional coil device usually uses a wire having a round cross section, a through-hole in a PCB for attaching the coil device also has a round cross section, which is different from the cross section of the aforementioned rectangular wire, thus requiring a change in designing the PCB in order to manufacture another PCB for enabling substitution by the rectangular wire, which causes difficulties in the substitution.

SUMMARY OF THE INVENTION

The present invention has been made in light of the above, and its object is to provide a coil device using an edgewise winding of a rectangular insulated wire, which has its applications expanded, contributes to miniaturization of apparatuses, and which eases design change control.

In order to achieve the above-described object, according to a first aspect of the present invention, a coil device comprises: at least one edgewise which has a rectangular insulated wire edgewise wound therearound; and a holder which receives the at least one edgewise winding mounted thereon, and which includes a plurality of terminal sections each composed of a pin-like terminal which has its one end portion adapted to be inserted in a printed circuit board (PCB) thus constituting a PCB insertion portion, and which has the other end portion embedded in the holder and connected to the at least one edgewise winding thus constituting a winding connection portion.

According to a second aspect of the present invention, in the coil device of the first aspect, terminations of the rectangular wire of the at least one edgewise winding are crooked and each hooked around the winding connection portion, thereby connecting the at least one edgewise winding and the plurality of terminal sections.

According to a third aspect of the present invention, in the coil device of the second aspect, the PCB insertion portion and the winding connection portion are oriented perpendicular to each other.

According to a fourth aspect of the present invention, in the coil device of the second aspect, the holder includes a plurality of curve guides, along each of which the rectangular wire near its termination is curved, and each of which is formed in a configuration having a curvature adapted to keep the rectangular wire elastically curved, thereby ensuring a firm contact between the winding connection portion and the termination crooked and hooked around said winding connection portion.

According to a fifth aspect of the present invention, in the coil device of the fourth aspect, the holder includes a plurality of bend guides, at each of which the rectangular wire at the start of leading out is bent, and each of which is formed in a configuration having a curvature adapted to keep the rectangular wire plastically bent.

According to a sixth or seventh aspect of the present invention, in the coil device of the fourth or fifth aspect, a curvature radius of each of the curve guides is 1 mm minimum when the rectangular wire has a thickness of 0.05 to 0.1 mm.

(Effects of the Present Invention)

In advance, the end portions of the coil have their insulation resin peeled off and are soldered. Therefore, after the end portions have been caught around the coil connection shafts, solders thereon are heated and melted by a soldering iron, thereby uniting them both without heating them to their melting points. Consequently, the present invention has the following advantages.

1. The above-described method can easily achieve an automation of soldering. 2. Since it is not necessary to dip any relevant part/component into a solder bath as done conventionally, any incidental defects such as deformation and pin-warp due to heat does not occur. 3. Since the above-described elastic deformation is maintained at a time of heating, the end portions of the coil are soldered with them pressed against the coil connection shafts, thereby enhancing reliability of intimate contact. 4. The above-described method can greatly decrease limitations on the size and weight of any relevant part/component.

DETAILED DESCRIPTION OF THE PREFERRED EMBODIMENTS

Figure 5:
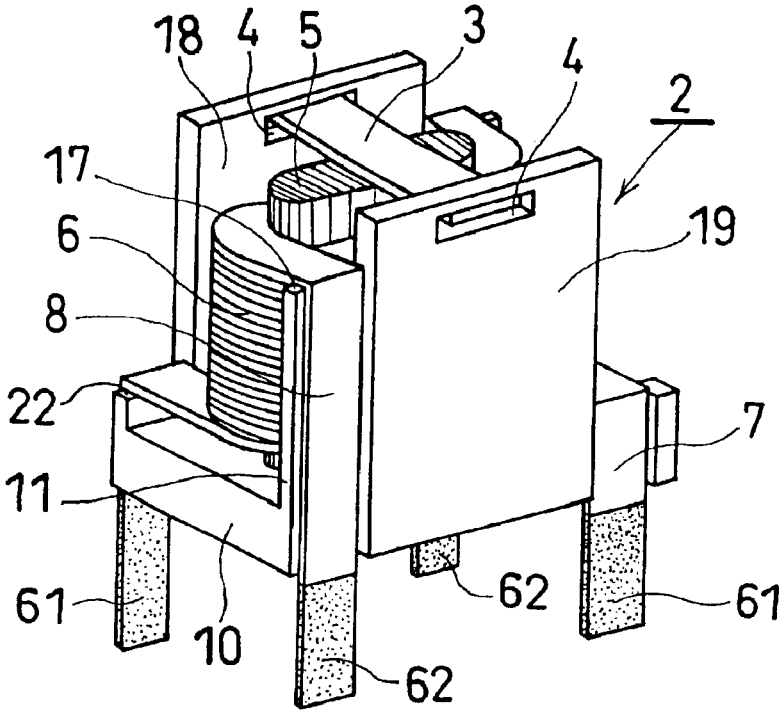
FIG. 5 PRIOR ART
FIG. 5 is a perspective view of a conventional coil device.
Figure 6:
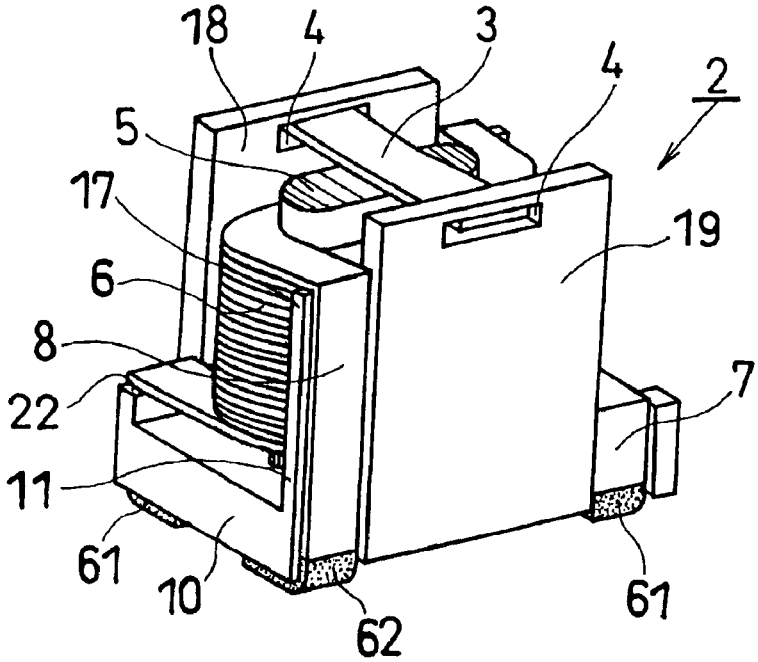
FIG. 6 PRIOR ART
FIG. 6 is a perspective view of another conventional coil device.

A preferred embodiment of the present invention will hereinafter be explained with reference to FIGS. 1 to 4. In FIGS. 1 to 4, sections and components that are identical with or equivalent to those shown in FIGS. 5 and 6 are represented by the same reference characters, and detailed descriptions thereof are omitted.

Figure 4:
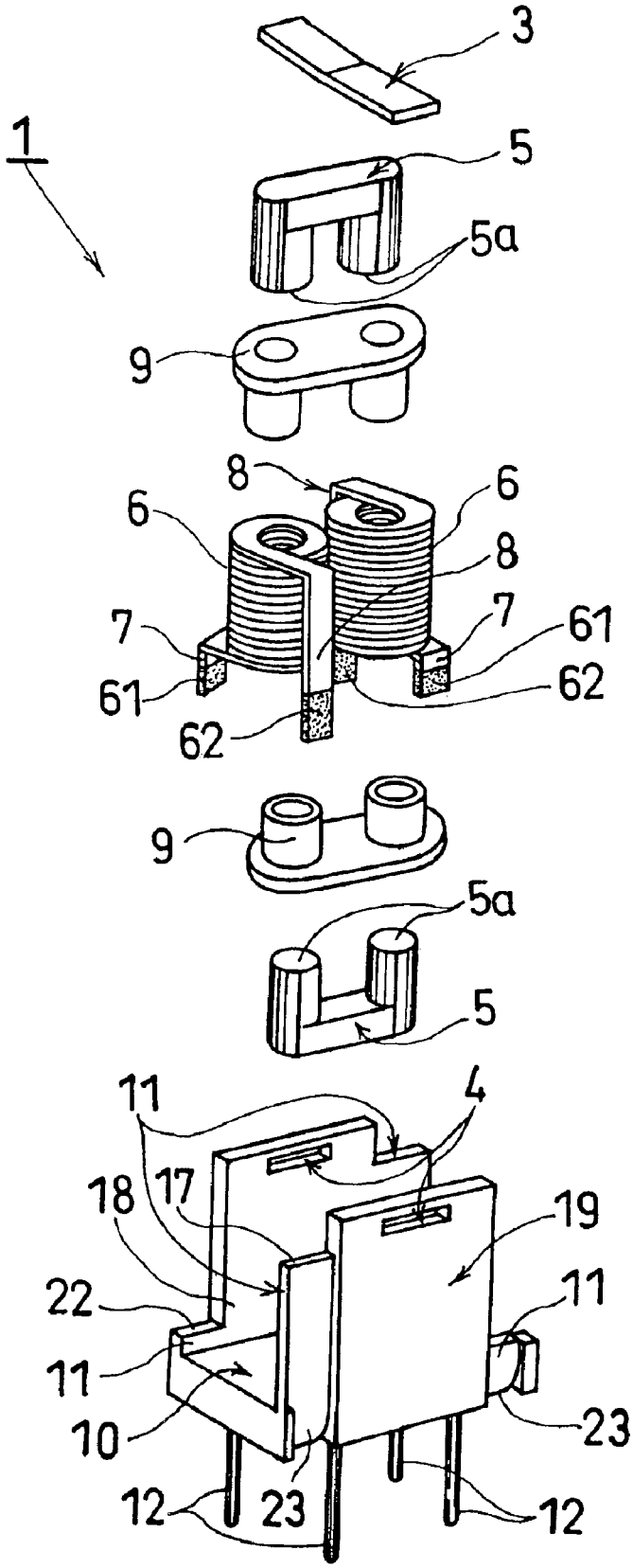
FIG. 4 is an exploded perspective view of the coil device of FIG. 1.

In the preferred embodiment discussed below, FIG. 4 shows a core 5 consisting of upper and lower sections is housed in a bobbin 9 consisting of upper and lower sections, but the bobbin 9 is not necessarily required and may be used as appropriate according to the withstand voltage or usage environment of a coil device.

Figure 1:
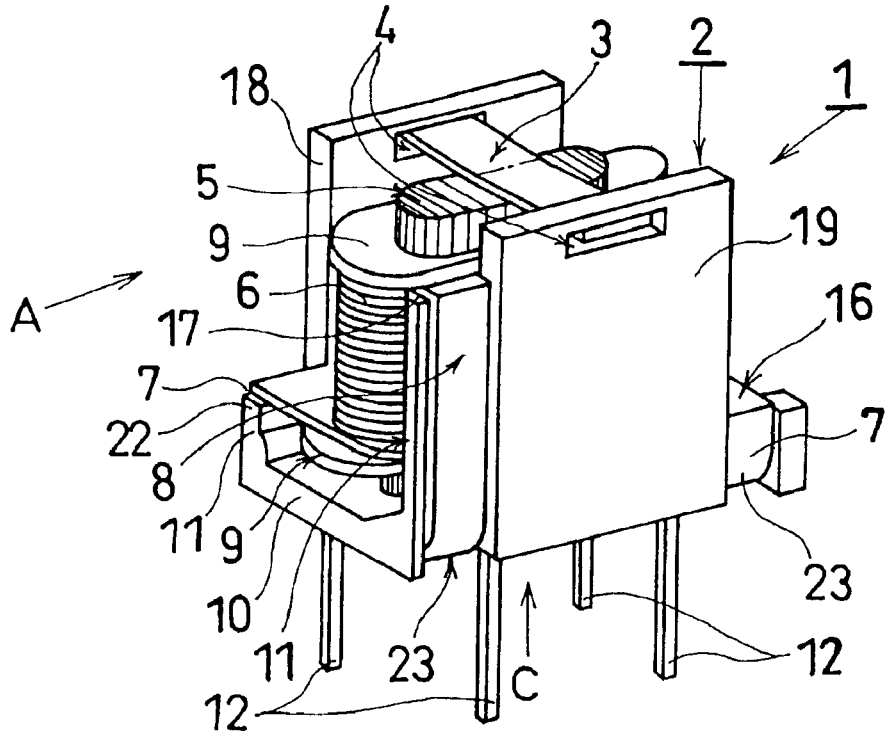
FIG. 1 is a perspective view of a coil device according to an embodiment of the present invention.

As shown in FIG. 1, a coil device 1 comprises a holder 2, and a pair of edgewise windings 6 each having a rectangular insulated wire therearound and mounted on the holder 2. The holder 2 includes four terminal sections 120 (see FIGS. 3B and 3C) each including a terminal pin bent at about 90 degrees into two portions, of which one portion 12 (hereinafter referred to as PCB insertion portion) is to be inserted in a printed circuit board (PCB), and the other portion 20 (hereinafter referred to as winding connection portion—see FIG. 2) is embedded in a base section 10 and connected to the edgewise winding 6.

The holder 2 has two side walls 18 and 19 which have respective slot holes 4 and 4 formed at their upper portions and adapted to engagingly receive a core securing plate spring 3. Each of the upper and lower sections of the bobbin 9 has its two cylindrical tube portions inserted respectively in the edgewise windings 6 and 6 formed of a rectangular wire, and each of the upper and lower sections of the core 5 has its two leg portions 5*a* and 5*a* inserted respectively in the two cylindrical tube portions of the bobbin 9. When the plate spring 3 is engagingly fitted in the slot holes 4 and 4, the top surface of the upper section of the core 5 is firmly held by means of the plate spring 3, thus pressing the core 5, the bobbin 9, and the windings 6 and 6 toward the base section of the holder 2.

Figure 2:
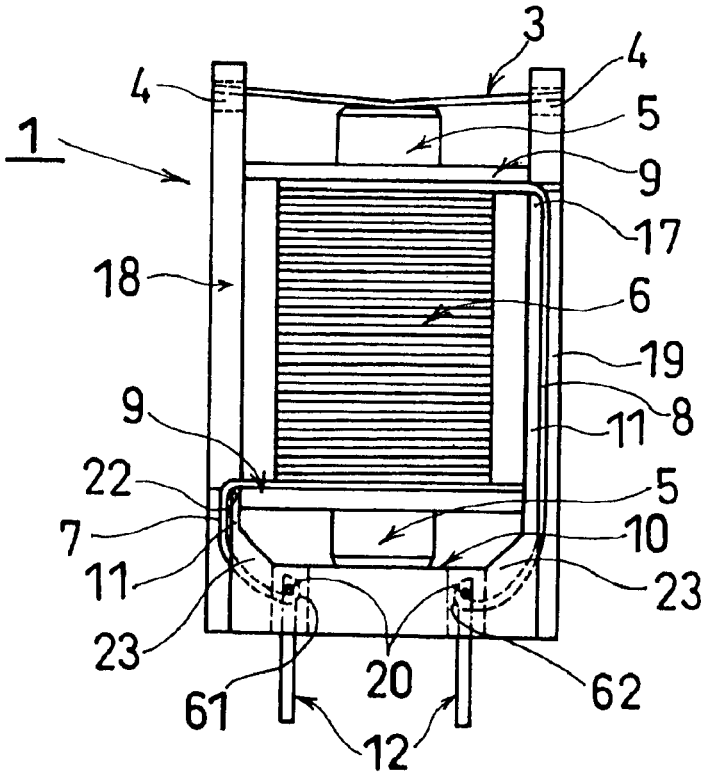
FIG. 2 is a front view of the coil device of FIG. 1 seen from a direction A indicated in FIG. 1.

As shown in FIGS. 1 and 2, two wire paths 11 and 11 for guiding the rectangular wires of the windings 6 and 6 are formed such that one wire path 11 of the two, which is short, is formed on one end surface of the side wall 18, and the other wire path 11, which is long, is formed on one end surface of the side wall 19, and each of the short and long wire paths 11 and 11 has a curve guide 23 formed continuously with its lower end. Another two wire guides 11 and 11 are similarly formed on the other end surfaces of the side walls 18 and 19 but with a long one on the side wall 18 and a short one on the side wall 19. Lead wires 7 and 8 of the winding 6 lead out along the short and long wire paths 11 and 11, respectively. The curve guide 23 is formed with a configuration having a curvature adapted to allow the rectangular wire (the lead wires 7 and 8) to be kept elastically curved. For example, in case of a rectangular copper wire having a thickness of 0.05 to 0.1 mm for use in a winding with a current value of 0.2 to 2.0 A, the curve guide 23 is formed preferably with a curvature radius of 1 mm minimum in order to keep the wire elastically curved. The lead wires 7 and 8 are bent at and in contact with respective curve guides 23 and 23, and have their terminations 61 and 62 crooked and hooked around respective winding connection portions 20 (see FIG. 3) of the terminal pins.

The long and short wire paths 11 and 11 have bend guides 17 and 22, respectively, formed continuously with their upper ends. Another two bend guides 17 and 22 are formed respectively on the other long and short wire paths 11 and 11. The bend guides 17 and 22 are formed with a configuration, for example having an edge of 90 degrees, adapted to make the rectangular wire plastically bent. The lead wires 7 and 8 are bent at the bend guides 17 and 22, respectively, at about 90 degrees at the start of their leading out, extend along the wire paths 11 and 11, are curved at the curve guides 23 and 23, and have their terminations 61 and 62 crooked and hooked around the winding connection portions 20 and 20 of the terminal pins. Since the lead wires 7 and 8 are curved with elasticity as described above, it is ensured that the terminations 61 and 62 hooked around the winding connection portions 20 and 20 are kept in constant and firm contact with the winding connection portions 20 and 20 as described hereinafter.

Referring to FIG. 2, the contact of the terminations 61 and 66 of the winding 6 with the respective winding connection portions 20 and 20 will be explained in detail. The lead wires 7 and 8 of the winding 6 are plastically bent at about 90 degrees at the bend guides 17 and 22, respectively, then extend along the wire paths 11 and 11, and are elastically curved with resilience along and in contact with the curve guides 23 and 23, and the terminations 61 and 62 of the lead wires 7 and 8 are elastically held due to the resilience and crooked and hooked around the winding connection portions 20 and 20 of the terminal pins provided on the lower surface of the base section 10 of the holder 2. The resilience of the lead wires 7 and 8 generated at the curve guides 23 and 23 causes the terminations 61 and 62 to press against the winding connection portions 20 and 20 of the terminal pins, thereby ensuring an intimate contact therebetween. In this connection, when the rectangular wire has a thickness of 0.05 to 0.1 mm, the winding connection portion 20 is preferably dimensioned to have a diameter of 0.5 to 1.5 mm.

Referring to FIG. 3, the holder 2 will be explained in detail. The holder 2 receives the pair of edgewise windings 6 on the base section 10 and includes, as mentioned above, the four terminal sections 120 each including a terminal pin bent at about 90 degrees into two portions, namely the PCB insertion portion 12 and the winding connection portion 20. The PCB insertion portion 12 is inserted in the PCB, and the winding connection portion 20 is connected to the winding 6 such that the termination 61 (62) of the lead wire 7 (8) of the winding 6 is crooked and hooked therearound. The terminal pin of the terminal portion 120 is bent at about 90 degrees to be shaped into an L-letter so that the winding connection portion 20 and the PCB insertion portion 12 are oriented substantially perpendicular to each other. The winding connection portion 20 including the bent area is embedded at a bottom side of the base section 10 opposite to a side having the windings 6 and 6, the core 5 and the bobbin 9 and has its distal portion (opposite to the bent area) sticking out from the base section 10 into an open space 24 formed in the base section 10 so that the termination 61 (62) of the lead wire 7 (8) of the winding 6 can be hooked around the winding connection portion 20 exposed in the open space 24, and the PCB insertion portion 12 is disposed so as to stand vertically on the bottom side of the base section 10.

Figure 3A:
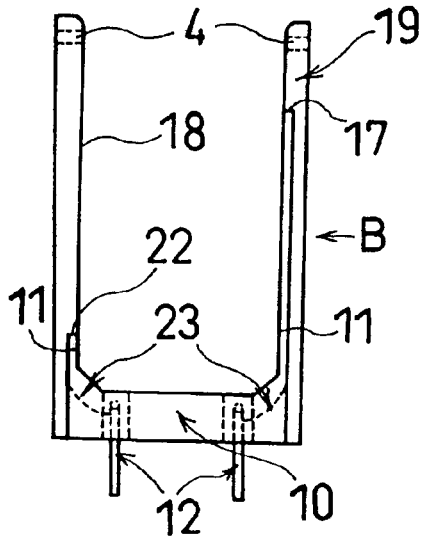
FIG. 3A is a front view (seen from the direction A) of a holder of the coil device of FIG. 1.
Figure 3B:
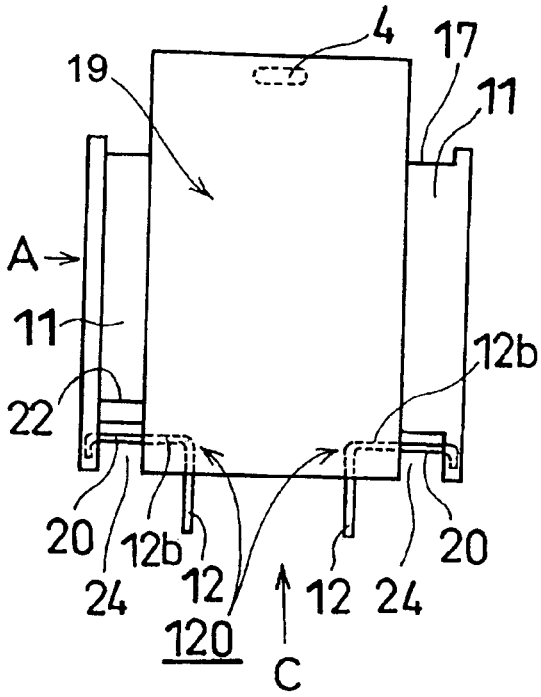
FIG. 3B is a right-side view of the holder of the FIG. 3A.
Figure 3C:
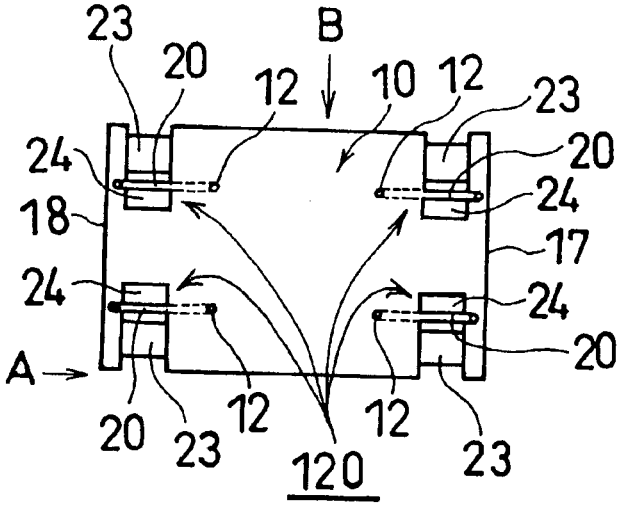
FIG. 3C is a bottom view of the holder of the FIG. 3A.
Figure 3D:
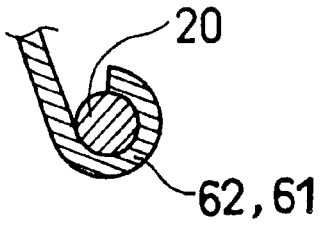
FIG. 3D is an enlarged view of a winding connection/termination of the coil device of FIG. 1.

The winding connection portion 20 is located corresponding to the position of the termination 61 (62) of the lead wire 7 (8). In this connection, the termination 61 (62) is rolled up (crooked) preferably with at least one half turn as shown in FIG. 3D, in order to prevent the termination 61 (62) from accidentally getting unhooked from the winding connection portion 20. The termination 61(62) has its insulation resin peeled off, has solder provided thereon and is hooked around the winding connection portion 20, and the solder on the terminations 61 (62) is heated and melted with a soldering iron or the like for soldering the terminations 61 (62) to the winding connection portion 20, thus soldering can be performed only by applying heat resulting in an easier automation of soldering. Also, since the terminal pin does not have to be dipped in a solder bath, the terminal pin does not deform or crook due to heat. And, since the termination 61(62) is kept elastic during the process of heating, the soldering is performed while the termination 61(62) is pressed against the winding connection portion 20, enhancing the reliability of the connection.

Referring to FIG. 4, the coil device 1 will be explained in detail. Legs 5*a*, 5*a*, 5*a* and 5*a* of the core 5 consisting of two (upper and lower) sections each shaped substantially like a U-letter are inserted into respective cylindrical tube portions of the bobbin 9 consisting of two (upper and lower) sections, and the cylindrical tube portions of the bobbin 9 having the legs 5*a* of the core 5 inserted therein are inserted into the windings 6 and 6 from above and under so that the legs 5*a* of the upper section of the core 5 come into contact with the legs 5*a* of the lower section of the core 5. The windings 6 and 6 having the core 5 and bobbin 9 inserted therein as described above are mounted on the base section 10 of the holder 2. The lead wires 7 and 8 of each winding 6 extend along and outside the wire paths 11 and 11 toward the curve guides 23 and 23. The plate spring 3 is engagingly fitted in the slot holes 4 and 4 each formed in the upper portion of each of the side walls 18 and 19, thereby fixedly pressing the core 5, the bobbin 9 and the windings 6 and 6 to the holder 2. Then, the lead wires 7 and 8 are curved elastically at the respective curve guides 23 and 23, and the terminations 61 and 62 of each winding 6 are crooked to be hooked around the respective winding connection portions 20 and 20. In the embodiment described above, two edgewise windings are provided, but alternatively only one edgewise winding may be provided. In such a case, the locations of the slot holes and the core securing plate spring, and the number of the terminal portions are modified accordingly. Further, the windings, which are mounted to stand vertically on the base section 10 in the embodiment described above, may alternatively be mounted to lie horizontally. In this case, the lead wires of the windings are configured accordingly.

What is claimed is:

1. A coil device, comprising:

at least one edgewise winding having a rectangular insulated wire edgewise wound therearound; and a holder on which said at least one edgewise winding is mounted, said holder including a plurality of terminal sections, each terminal section comprising a terminal including a PCB insertion portion at one end, said PCB insertion portion being adapted to be inserted in a printed circuit board (PCB) and a winding connection portion at another end, said winding connection portion being embedded in said holder and being connected to said at least one edgewise winding, wherein said PCB insertion portion and said winding connection portion are oriented at or about 90° relative to each other.

2. A coil device as claimed in claim 1, wherein each termination of said rectangular insulated wire of said at least one edgewise winding is crooked and hooks around said winding connection portion, thereby connecting said at least one edgewise winding and said plurality of terminal sections.

3. A coil device as claimed in claim 2, wherein said winding connection portion extends along a width direction of a lead wire or said rectangular wire.

4. A coil device as claimed in claim 2, wherein said holder includes a plurality of curve guides, along each of which said rectangular insulated wire is curved immediately before said termination, and each of the plurality of curve guides being formed in a configuration having a curvature adapted to keep said rectangular wire elastically curved, whereby a firm contact is ensured between said winding connection portion and said termination that is crooked and hooked around said winding connection portion.

5. A coil device as claimed in claim 4, wherein a curvature radius of each of said curve guides is at least about 1 mm when said rectangular wire has a thickness of about 0.05 mm to about 0.1 mm.

6. A coil device as claimed in claim 4, wherein said holder includes a plurality of bend guides, at each of which said rectangular wire is bent at a start of leading out, and each of which is formed in a configuration having a curvature adapted to keep said rectangular wire plastically bent, whereby said firm contact is further ensured.

7. A coil device as claimed in claim 6, wherein a curvature radius of each of said curve guides is at least about 1 mm when said rectangular wire has a thickness of about 0.05 mm to about 0.1 mm.

8. A coil device, comprising:

at least one edgewise winding having a rectangular insulated wire edgewise wound therearound; and a holder on which said at least one edgewise winding is mounted, said holder including a plurality of terminal sections, each terminal section comprising a terminal including a PCB insertion portion at one end, said PCB insertion portion being adapted to be inserted in a printed circuit board (PCB) and, a winding connection portion at another end, said winding connection portion being embedded in said holder and being connected to said at least one edgewise winding, wherein:

each termination of said rectangular insulated wire of said at least one edgewise winding is crooked and hooks around said winding connection portion, thereby connecting said at least one edgewise winding and said plurality of terminal sections, and said holder includes a plurality of curve guides, along each of which said rectangular insulated wire is curved immediately before said termination, and each of the plurality of curve guides being formed in a configuration having a curvature adapted to keep said rectangular wire elastically curved, whereby a firm contact is ensured between said winding connection portion and said termination that is crooked and hooked around said winding connection portion.

9. A coil device as claimed in claim 8, wherein said winding connection portion extends along a width direction of a lead wire or said rectangular wire.

10. A coil device as claimed in claim 8, wherein a curvature radius of each of said curve guides is at least about 1 mm when said rectangular wire has a thickness of about 0.05 mm to about 0.1 mm.

11. A coil device as claimed in claim 8, wherein said holder includes a plurality of bend guides, at each of which said rectangular wire is bent at a start of leading out, and each of which is formed in a configuration having a curvature adapted to keep said rectangular wire plastically bent, whereby said firm contact is further ensured.

12. A coil device as claimed in claim 11, wherein a curvature radius of each of said curve guides is at least about 1 mm when said rectangular wire has a thickness of about 0.05 mm to about 0.1 mm.

13. A coil device, comprising:

at least one edgewise winding having a rectangular insulated wire edgewise wound therearound; and a holder on which said at least one edgewise winding is mounted, said holder including a plurality of terminal sections, each terminal section comprising a terminal including a PCB insertion portion of one end, said PCB insertion portion adapted to be inserted in a printed circuit board (PCB), and a winding connection portion at another end, said winding connection portion being embedded in said holder and being connected to said at least one edgewise winding, wherein said PCB insertion portion and said winding connection portion are oriented at or about 90° relative to each other, each termination of said rectangular insulated wire of said at least one edgewise winding is crooked and hooks around said winding connection portion, thereby connecting said at least one edgewise winding and said plurality of terminal sections, and said holder includes a plurality of curve guides, along each of which said rectangular wire is curved before said termination, and each of the plurality of curve guides being formed in a configuration having a curvature adapted to keep said rectangular wire elastically curved, whereby a firm contact is ensured between said winding connection portion and said termination that is crooked and hooked around said winding connection portion.

* * * * *